US009533857B2

(12) United States Patent
Mitsuda

(10) Patent No.: US 9,533,857 B2
(45) Date of Patent: Jan. 3, 2017

(54) ELEVATOR GROUP MANAGEMENT DEVICE

(75) Inventor: Masayuki Mitsuda, Aichi (JP)

(73) Assignee: Mitsubishi Electric Corporation, Tokyo (JP)

( * ) Notice: Subject to any disclaimer, the term of this patent is extended or adjusted under 35 U.S.C. 154(b) by 400 days.

(21) Appl. No.: 14/364,504

(22) PCT Filed: Feb. 23, 2012

(86) PCT No.: PCT/JP2012/054415

§ 371 (c)(1),
(2), (4) Date: Jun. 11, 2014

(87) PCT Pub. No.: WO2013/125008

PCT Pub. Date: Aug. 29, 2013

(65) Prior Publication Data

US 2014/0367203 A1 Dec. 18, 2014

(51) Int. Cl.

| | |
|---|---|
| ***B66B 1/28*** | (2006.01) |
| ***B66B 1/24*** | (2006.01) |
| *B66B 19/00* | (2006.01) |

(52) U.S. Cl.

CPC ..... *B66B 1/2408* (2013.01); *B66B 1/2458* (2013.01); *B66B 19/007* (2013.01)

(58) Field of Classification Search

CPC ..... B66B 1/2408; B66B 1/2458; B66B 19/007

(Continued)

(56) References Cited

U.S. PATENT DOCUMENTS

| | | |
|---|---|---|
| 4,724,931 A | 2/1988 | Ichioka |
| 4,844,204 A | 7/1989 | Ovaska et al. |

(Continued)

FOREIGN PATENT DOCUMENTS

| | | |
|---|---|---|
| JP | 62 31682 | 2/1987 |
| JP | 60 252575 | 6/1987 |

(Continued)

OTHER PUBLICATIONS

English translation of the International Preliminary Report on Patentability and Written Opinion issued Sep. 4, 2014, in PCT/JP2012/054415 filed Feb. 23, 2012.

(Continued)

*Primary Examiner* — Anthony Salata
(74) *Attorney, Agent, or Firm* — Oblon, McClelland, Maier & Neustadt, L.L.P.

(57) ABSTRACT

An elevator group management device includes: an existing car control device controlling an existing car; a newly-installed car control device controlling a newly-installed car; an evaluation value preparing mechanism preparing evaluation values for the existing car and the newly-installed car; an assignment determining mechanism determining a car assigned to a call based on the prepared evaluation values; an existing car storage beforehand storing information concerning which of the cars is the existing car; and a weight storage beforehand storing a weighting factor for the existing car in the evaluation value. The evaluation value preparing mechanism prepares the evaluation value for the existing car by using the existing car storage information and the weighting factor. The elevator group management device can realize proper car assignment while suppressing occurrence of failure and considering operation efficiency when the existing car and newly-installed car are managed and controlled as one group.

15 Claims, 11 Drawing Sheets

1: EXISTING CAR
2: EXISTING CAR CONTROL DEVICE
3: NEWLY-INSTALLED CAR
4: NEWLY-INSTALLED CAR CONTROL DEVICE
5: GROUP MANAGEMENT CONTROL DEVICE
6: HALL BUTTON
7: ASSIGNMENT DETERMINING MEANS
8: EXISTING CAR STORING MEANS
9: WEIGHT STORING MEANS
10: WEIGHT PREPARING MEANS

(58) Field of Classification Search
USPC ..... 187/247, 248, 380–388, 391–396
See application file for complete search history.

(56) References Cited

U.S. PATENT DOCUMENTS

| | | | | |
|---|---|---|---|---|
| 7,264,087 | B2 * | 9/2007 | Hawkins | B66B 11/007 187/281 |
| 7,467,691 | B2 * | 12/2008 | Deplazes | B66B 7/021 187/249 |
| 7,900,750 | B2 * | 3/2011 | Mattsson | B66B 1/2458 187/247 |
| 8,662,255 | B2 * | 3/2014 | Flynn | B66B 1/2458 187/247 |
| 2008/0149432 | A1 | 6/2008 | Friedli et al. | |
| 2014/0174861 | A1 * | 6/2014 | Sarjanen | B66B 1/2458 187/387 |
| 2015/0274488 | A1 * | 10/2015 | Ramakrishnan | B66B 19/007 187/387 |

FOREIGN PATENT DOCUMENTS

| | | |
|---|---|---|
| JP | 2008 156117 | 2/1996 |
| JP | 8 18767 | 4/2002 |
| JP | 2002 114458 | 4/2002 |
| JP | 62 126086 | 7/2008 |
| JP | 2011 162294 | 8/2011 |
| JP | 2012 502863 | 2/2012 |

OTHER PUBLICATIONS

International Search Report Issued Aug. 7, 2012 in PCT/JP12/054415 Filed Feb. 23, 2012.

* cited by examiner

1: EXISTING CAR
2: EXISTING CAR CONTROL DEVICE
3: NEWLY-INSTALLED CAR
4: NEWLY-INSTALLED CAR CONTROL DEVICE
5: GROUP MANAGEMENT CONTROL DEVICE
6: HALL BUTTON
7: ASSIGNMENT DETERMINING MEANS
8: EXISTING CAR STORING MEANS
9: WEIGHT STORING MEANS
10: WEIGHT PREPARING MEANS

1: EXISTING CAR
2: EXISTING CAR CONTROL DEVICE
3: NEWLY-INSTALLED CAR
4: NEWLY-INSTALLED CAR CONTROL DEVICE
5: GROUP MANAGEMENT CONTROL DEVICE
6: HALL BUTTON
7: ASSIGNMENT DETERMINING MEANS
8: EXISTING CAR STORING MEANS
9: WEIGHT STORING MEANS
10: WEIGHT PREPARING MEANS
11: FAILURE RATE STORING MEANS

1: EXISTING CAR
2: EXISTING CAR CONTROL DEVICE
3: NEWLY-INSTALLED CAR
4: NEWLY-INSTALLED CAR CONTROL DEVICE
5: GROUP MANAGEMENT CONTROL DEVICE
6: HALL BUTTON
7: ASSIGNMENT DETERMINING MEANS
8: EXISTING CAR STORING MEANS
9: WEIGHT STORING MEANS
10: WEIGHT PREPARING MEANS
12: EXISTING CAR WEAR/DETERIORATION STATE STORING MEANS
13: WEAR/DETERIORATION STATE INPUTTING MEANS

1: EXISTING CAR
2: EXISTING CAR CONTROL DEVICE
3: NEWLY-INSTALLED CAR
4: NEWLY-INSTALLED CAR CONTROL DEVICE
5: GROUP MANAGEMENT CONTROL DEVICE
6: HALL BUTTON
7: ASSIGNMENT DETERMINING MEANS
8: EXISTING CAR STORING MEANS
9: WEIGHT STORING MEANS
14: MODIFICATION SCHEDULE STORING MEANS

FIG. 10

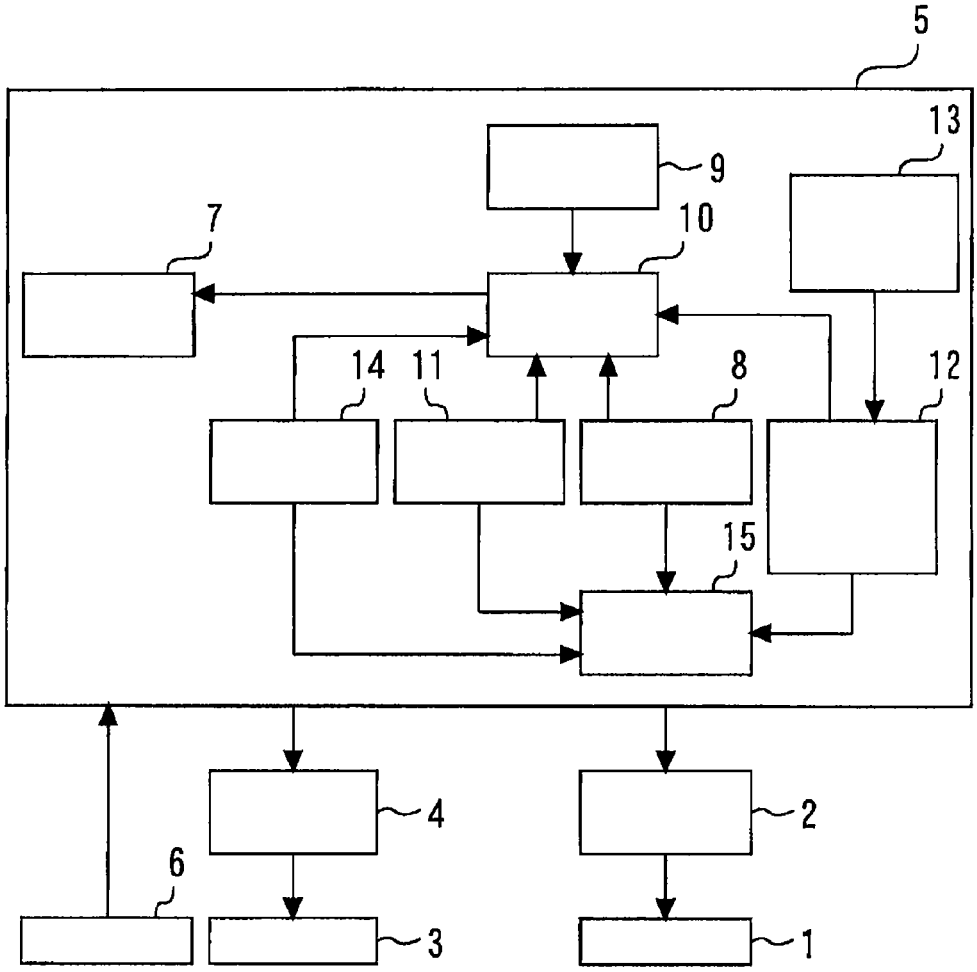

1: EXISTING CAR
2: EXISTING CAR CONTROL DEVICE
3: NEWLY-INSTALLED CAR
4: NEWLY-INSTALLED CAR CONTROL DEVICE
5: GROUP MANAGEMENT CONTROL DEVICE
6: HALL BUTTON
7: ASSIGNMENT DETERMINING MEANS
8: EXISTING CAR STORING MEANS
9: WEIGHT STORING MEANS
10: WEIGHT PREPARING MEANS
11: FAILURE RATE STORING MEANS
12: EXISTING CAR WEAR/DETERIORATION STATE STORING MEANS
13: WEAR/DETERIORATION STATE INPUTTING MEANS
14: MODIFICATION SCHEDULE STORING MEANS
15: PAUSED CAR DETERMINING MEANS

ELEVATOR GROUP MANAGEMENT DEVICE

TECHNICAL FIELD

The present invention relates to an elevator group management device.

BACKGROUND ART

As a conventional elevator group management device, there have been conventionally known a device in which a matching computer is connected between an existing car control device and a newly installed group management control device to place existing cars under management control of the new group management control device (for example, refer to Patent Literature 1), and a device in which existing elevators can be placed under management control of a new group management control device by exchanging state signals and operation signals via the display equipment and operation equipment of existing elevators (for example, refer to Patent Literature 2).

Also, the elevator environment is sometimes an environment in which, by the modernization of elevator, already-existing cars and newly-installed cars are caused to mixedly exist. As an elevator group management device in such an environment in which the already-existing cars and newly-installed cars exist mixedly, there has been conventionally known a device in which a hall call button is connected to an already-existing group management control device and a newly-installed group management control device via a call detection unit, and an inputted hall call is allotted to either of the already-existing group management control device and the newly-installed group management control device in accordance with predetermined rules of random assignment, alternate assignment, and the like (for example, refer to Patent Literature 3).

Also, as an elevator group management device assuming the same environment, there has also been conventionally known a device in which, in the case where already-existing cars placed under management control of the already-existing group management control device and newly-installed cars placed under management control of the newly-installed group management control device exist mixedly, all of the hall calls are taken in the newly-installed group management control device, and thereafter some hall calls are transmitted to the already-existing group management control device according to the ratio of the number of new and old elevators or the like (for example, refer to Patent Literature 4).

On the other hand, from a viewpoint other than the above ones, for an elevator in which the motion state of each of a plurality of elevators is supervised to detect a sign of failure, there has also been conventionally known an elevator group management control device configured so that a call is not assigned excluding the crowded time when all of other elevators are in operation (for example, refer to Patent Literature 5).

CITATION LIST

Patent Literature

Patent Literature 1: Japanese Patent Laid-Open No. 60-252575

Patent Literature 2: Japanese Patent Laid-Open No. 62-126086

Patent Literature 3: Japanese Patent Laid-Open No. 2008-156117

Patent Literature 4: Japanese Patent Publication No. 8-018767

Patent Literature 5: Japanese Patent Laid-Open No. 2002-114458

SUMMARY OF INVENTION

Technical Problem

Generally, it has been known that the change in failure rate of machinery and equipment with the elapse of time draws a so-called bathtub curve of a bathtub form. That is to say, when a certain time period has elapsed, the failure rate of machinery and equipment rises with the elapse of time, and therefore it is thought that, for an elevator, an already-existing car is in a state in which the failure rate is high as compared with the newly-installed car.

However, in the conventional elevator group management devices disclosed in Patent Literatures 1 to 4, concerning the assignment of call, the already-existing elevators and the newly-installed elevators are dealt with equally, whereby the decrease in operation efficiency is suppressed. Therefore, these elevator group management devices have a problem that there is a high possibility that a failure occurs and a problem arises during the operation of already-existing car, that is, during the time when the users are on board.

Also, the conventional elevator group management device disclosed in Patent Literature 5, excluding the crowded time when all of other elevators are in operation, a call is not assigned to the elevator that has detected a sign such that the number of times of motions of equipment has exceeded the predetermined number of times. Therefore, this elevator group management device has a problem that the availability of the elevator that has detected the sign decreases greatly, and resultantly there is a possibility that the operation efficiency of the whole is impaired.

The present invention has been made to solve such problems, and an object thereof is to provide an elevator group management device that can realize proper car assignment while not only suppressing the occurrence of failure but also considering the operation efficiency in the case where a plurality of cars including an existing car and a newly-installed car are managed and controlled as one group.

Means for Solving the Problems

An elevator group management device according to the present invention, which manages and controls a plurality of cars including an existing car and a newly-installed car as one group, comprises: an existing car control device which controls the existing car; a newly-installed car control device which controls the newly-installed car; evaluation value preparing means which prepares evaluation values for the existing car and the newly-installed car; assignment determining means which determines a car assigned to a call from among the plurality of cars on a basis of the evaluation values prepared by the evaluation value preparing means; existing car storing means which beforehand stores information concerning which of the plurality of cars is the existing car; and weight storing means which beforehand stores a weighting factor for the existing car in the evaluation value, wherein the evaluation value preparing means prepares the evaluation value for the existing car by using the storage contents of the existing car storing means and the weighting factor stored by the weight storing means.

Advantageous Effect of Invention

The elevator group management device in accordance with the present invention achieves an effect that proper car assignment can be realized while not only suppressing the occurrence of failure but also considering the operation efficiency in the case where a plurality of cars including an existing car and a newly-installed car are managed and controlled as one group.

BRIEF DESCRIPTION OF THE DRAWINGS

FIG. 10 is a block diagram showing the general configuration of an elevator group management device related to Embodiment 5 of the present invention.

DESCRIPTION OF EMBODIMENTS

Figure 1:
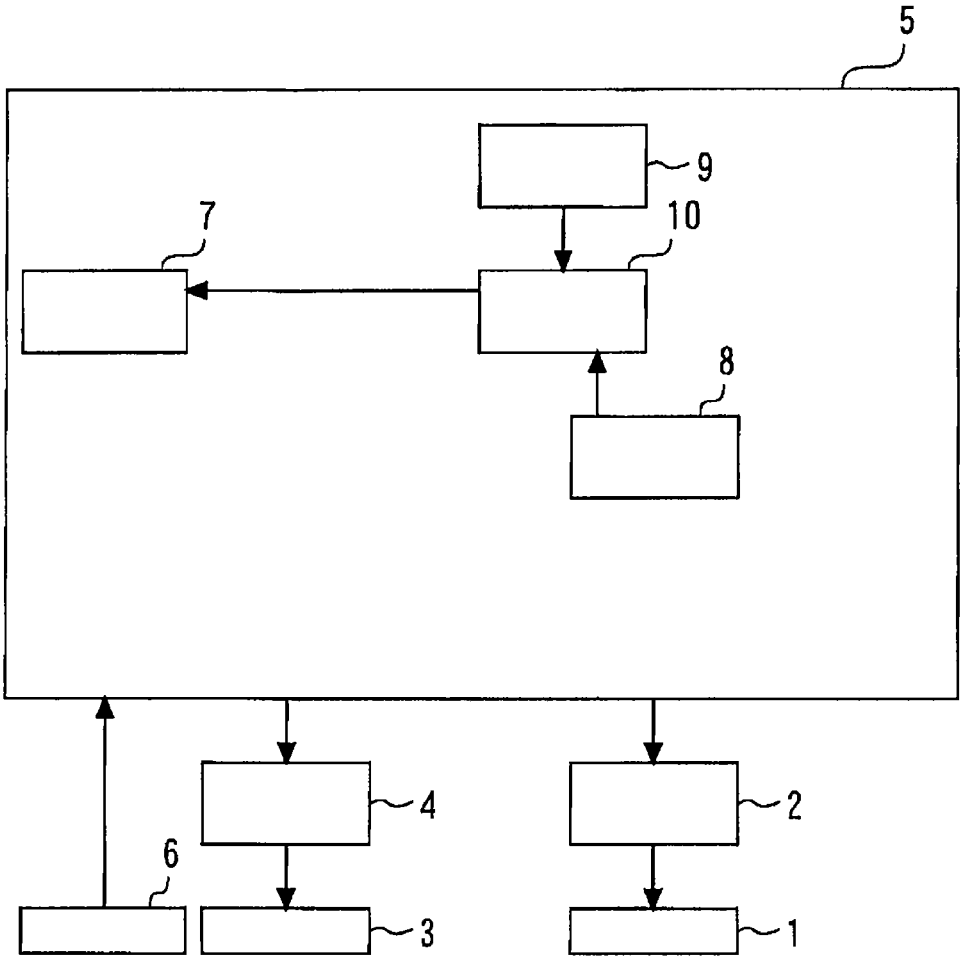
FIG. 1 is a block diagram showing the general configuration of an elevator group management device related to Embodiment 1 of the present invention.

The present invention will now be explained with reference to the accompanying drawings. In the drawings, the same reference signs denote the same or equivalent parts, and the duplicated explanation thereof is simplified or omitted as appropriate.

Embodiment 1

Figure 2:
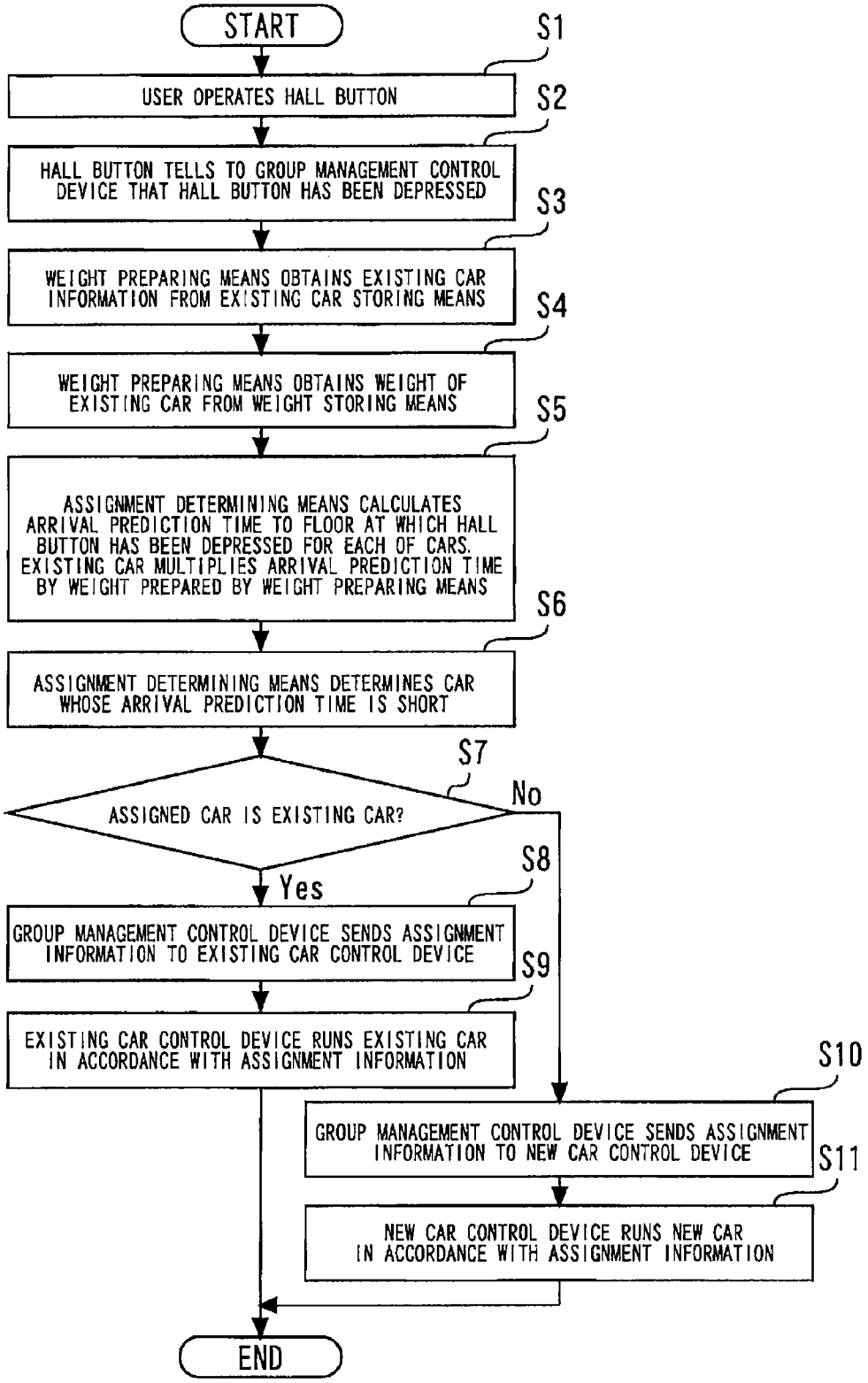
FIG. 2 is a flowchart showing the motion of the elevator group management device related to Embodiment 1 of the present invention.

FIGS. 1 and 2 relate to Embodiment 1 of the present invention. FIG. 1 is a block diagram showing the general configuration of an elevator group management device, and FIG. 2 is a flowchart showing the motion of the elevator group management device.

In FIG. 1, reference sign 1 denotes an existing car of an already installed elevator. The operation of this existing car 1 is controlled by an existing car control device 2. Also, reference sign 3 denotes a newly-installed car of a newly installed elevator. The operation of this newly-installed car 3 is controlled by a newly-installed car control device 4.

Although only one existing car 1 and only one newly-installed car 3 are shown in FIG. 1, the existing car 1 and newly-installed car 3 may be provided in plural numbers, respectively. That is to say, at least one existing car 1 and at least one newly-installed car 3 are provided. The existing car control device 2 is provided in numbers equal to the number of the existing cars 1 so as to correspond to the at least one existing car 1, and the newly-installed car control device 4 is provided in numbers equal to the number of the newly-installed cars 3 so as to correspond to the at least one newly-installed car 3.

To manage and control the plurality of cars including the existing car 1 and newly-installed car 3 as one group, a group management control device 5 is provided as a host device of the existing car control devices 2 and the newly-installed car control devices 4.

Also, in a hall of a floor at which the existing cars 1 and the newly-installed cars 3 stop, a hall button 6 for the user to register a hall call is provided. When the user operates the hall button 6, an operation signal is delivered from the operated hall button 6 to the group management control device 5. On receipt of this operation signal, the group management control device 5 registers a hall call to the floor at which the hall button 6 from which the operation signal has been delivered is provided.

The group management control device 5 is provided with an assignment determining means 7 for determining an assigned car to be assigned from among the plurality of existing cars 1 and newly-installed cars 3 with respect to the hall call thus registered.

This assignment determining means 7 first calculates, for each of the plurality of existing cars 1 and newly-installed cars 3, arrival prediction time, which is predicted to be necessary for each car to arrive at the floor at which the hall call has been registered, on the basis of the operation state of each car. Concerning the newly-installed car 3, this calculated arrival prediction time is made the evaluation value thereof. Also, concerning the existing car 1, a value obtained by multiplying this calculated arrival prediction time by a weighting factor, described later, is made the evaluation value thereof. That is to say, the evaluation value of the newly-installed car 3 and the evaluation value of the existing car 1 are calculated by the following formulas.

(evaluation value of newly-installed car 3)=(arrival prediction time of newly-installed car 3)

(evaluation value of existing car 1)=(arrival prediction time of existing car 1)?

(Weighting Factor)

The assignment determining means 7 compares the evaluation values thus calculated for respective cars, and determines the car having the smallest evaluation value to be an assigned car assigned to a call.

After the assigned car has been determined as described above, assignment information is sent from the group management control device 5 to the existing car control device 2 or newly-installed car control device 4 that controls the concerned assigned car. According to this assignment information, the existing car control device 2 or newly-installed car control device 4 runs the assigned car (the existing car 1 or the newly-installed car 3) to the floor at which the call has been registered to respond to the registered call.

To prepare the weighting factor used in the calculation of evaluation value in the assignment determining means 7, the group management control device 5 is provided with an existing car storing means 8, a weight storing means 9, and a weight preparing means 10. The existing car storing means 8 beforehand stores the existing car information concerning which car of the plurality of cars being managed and controlled by the group management control device 5 is the existing car 1. The weight storing means 9 beforehand stores the value of weighting factor for each existing car 1 stored by the existing car storing means 8.

The weight preparing means 10 obtains the existing car information from the existing car storing means 8, and obtains the weighting factor for the existing car 1 from the weight storing means 9, and thereby prepares the weighting factor for the use in the calculation of evaluation value of each of the existing cars 1 in the assignment determining means 7. As described above, the assignment determining means 7 makes the value obtained by multiplying the calculated arrival prediction time by the weighting factor prepared by the weight preparing means 10 the evaluation value of the existing car 1.

The flowchart of FIG. 2 shows the motion of the elevator group management control device in this embodiment.

First, when the user operates the hall button 6 in Step S1, the operated hall button 6 sends an operation signal to the group management control device 5 (Step S2), and the group management control device 5 registers the hall call to the floor at which the hall button 6 from which the operation signal has been sent is provided.

In the successive Step S3, the weight preparing means 10 of the group management control device 5 obtains the information concerning the existing car 1 from the existing car storing means 8. Then, the process proceeds to Step S4, where the weight preparing means 10 obtains the weighting factor for the existing car 1 from the weight storing means 9 on the basis of the obtained information concerning the existing car 1. After Step S4, the process proceeds to Step S5.

In Step S5, the assignment determining means 7 first calculates, for each car, the arrival prediction time to the floor at which the hall call has been registered (that is, the floor provided with the hall button 6 operated in Step S2). For the existing car 1, the assignment determining means 7 multiplies the calculated arrival prediction time by the weighting factor prepared by the weight preparing means 10 in Step S4. After the evaluation of arrival prediction time has been finished for all of the existing cars 1 and the newly-installed cars 3, the process proceeds to Step S6.

In Step S6, among all of the existing cars 1 and the newly-installed cars 3, the car having the smallest evaluation value (having the shortest arrival prediction time) is determined to be an assigned car. Herein, the weighting factor for the existing car 1 stored by the weight storing means 9 is set to a value of 1 or larger. Also, for the newly-installed car 3, since the value of arrival prediction time is used as the evaluation value as it is, it can be said that the evaluation value is calculated assuming that the weighting factor is 1. Therefore, the degree of priority of assignment of the existing car 1 is made low by the weighting factor, and the existing car 1 is caused to be less liable to be determined to be an assigned car. Also, it is possible that the existing car 1 can be caused not to be determined substantially to be an assigned car, for example, by setting the weighting factor for the existing car 1 to an extremely large value.

After Step S6, the process proceeds to Step S7, where it is judged whether or not the assigned car determined in Step S6 is the existing car 1. In this judgment, if the assigned car is the existing car 1, the process proceeds to Step S8. In Step S8, the group management control device 5 sends assignment information to the existing car control device 2. In the successive Step S9, on receipt of this assignment information, the existing car control device 2 runs the existing car 1 to the floor at which the call has been registered in accordance with the received assignment information.

On the other hand, if the assigned car is not the existing car 1 but the newly-installed car 3 in Step S7, the process proceeds to Step S10. In Step S10, the group management control device 5 sends assignment information to the newly-installed car control device 4. In the successive Step S11, the newly-installed car control device 4 runs the newly-installed car 3 to the floor at which the call has been registered in accordance with the received assignment information.

The above is an explanation of the case where the assignment determining means 7 performs both of the preparation of the evaluation value of the existing car 1 and the newly-installed car 3 and the determination of assigned car on the basis of the prepared evaluation value. However, in this respect, the configuration may be made such that there is separately provided an evaluation value preparing means for preparing the evaluation value for each of the existing cars 1 and newly-installed cars 3, and the assignment determining means 7 determines an assigned car on the basis of the evaluation value prepared by this evaluation value preparing means.

The elevator group management device configured as described above is an elevator group management device that manages and controls a plurality of cars including an existing car and a newly-installed car, including an existing car control device for controlling the existing car; a newly-installed car control device for controlling the newly-installed car; an assignment determining means for preparing evaluation values for the existing car and newly-installed car and for determining a car assigned to a call from among the plurality of cars on the basis of the evaluation values prepared; an existing car storing means for beforehand storing information concerning which of the plurality of cars is the existing car; and a weight storing means for beforehand storing a weighting factor for the existing car in the evaluation value, wherein the assignment determining means prepares the evaluation value for the existing car by using the storage contents of the existing car storing means and the weighting factor stored by the weight storing means.

Therefore, by properly adjusting the frequency at which a call is assigned to the existing car, proper car assignment can be realized while not only suppressing the occurrence of failure but also considering the operation efficiency.

Embodiment 2

Figure 3:
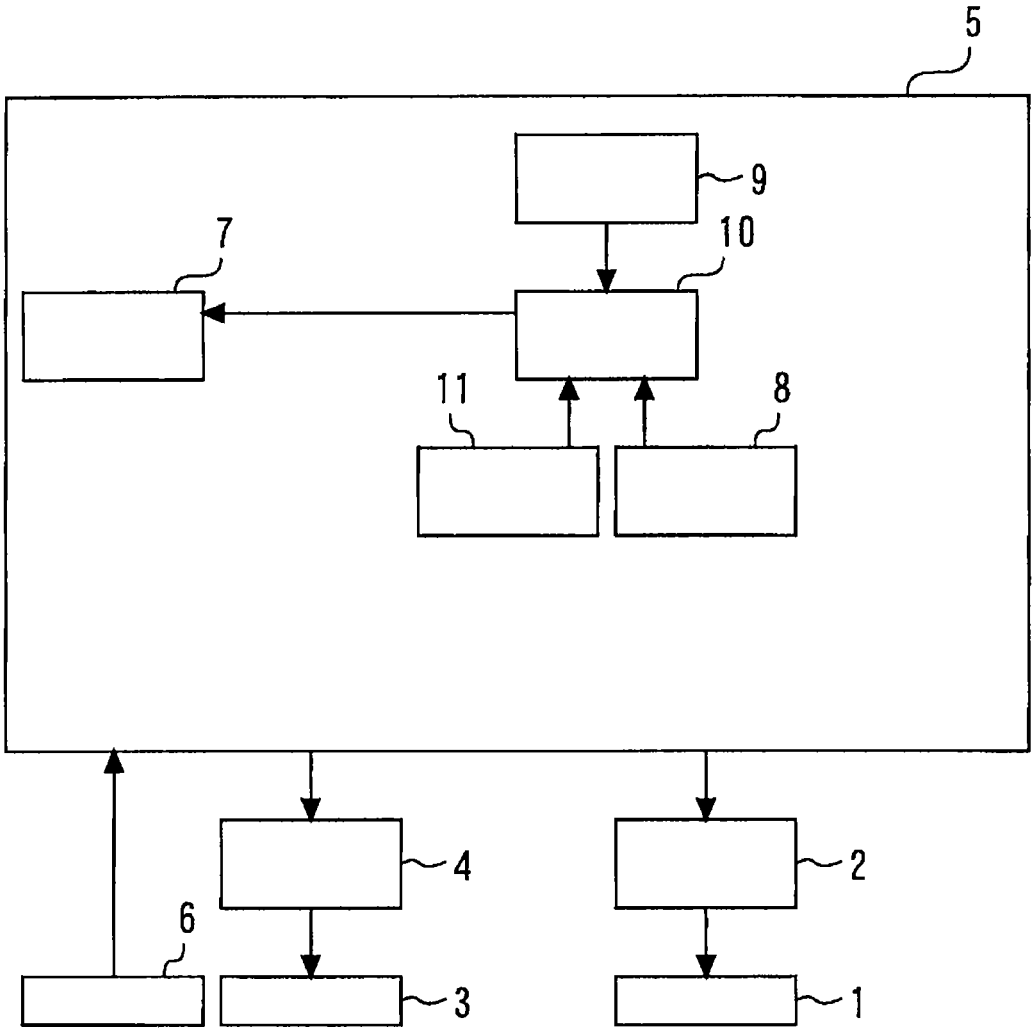
FIG. 3 is a block diagram showing the general configuration of an elevator group management device related to Embodiment 2 of the present invention.
Figure 4:
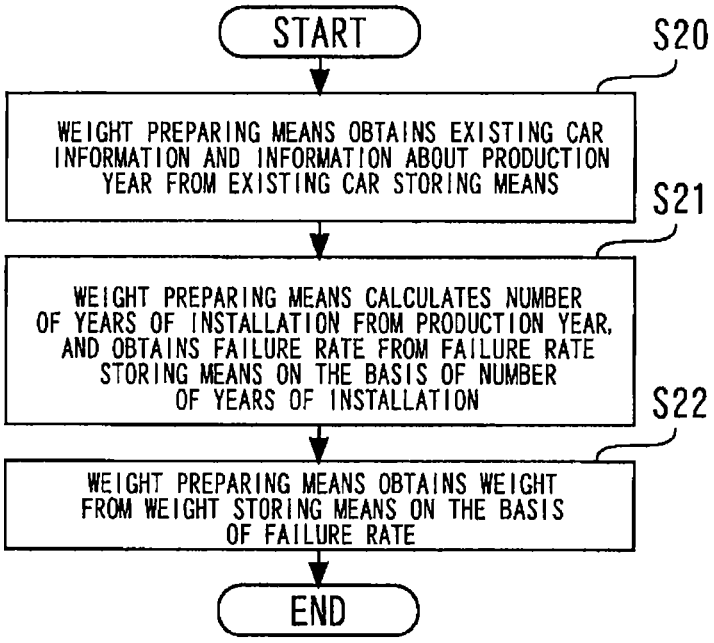
FIG. 4 is a flowchart showing weight factor obtainment processing at the time when an evaluation value is prepared in the elevator group management device related to Embodiment 2 of the present invention.

FIGS. 3 and 4 relate to Embodiment 2 of the present invention. FIG. 3 is a block diagram showing the general configuration of an elevator group management device, and FIG. 4 is a flowchart showing weight factor obtainment processing at the time when an evaluation value is prepared in the elevator group management device.

Embodiment 2 explained here is an embodiment in which, in the above-described configuration of Embodiment 1, the value of weighting factor used when the evaluation value of the existing car is calculated is changed according to the failure rate due to the installation period of the existing car.

That is to say, in FIG. 3, the existing car storing means 8 provided in the group management control device 5 beforehand stores information concerning the production time of each of the existing cars 1 in addition to the existing car information concerning which of the plurality of cars being managed and controlled by the group management control device 5 is the existing car 1.

The group management control device 5 is provided with a failure rate storing means 11 for beforehand storing the failure rate of the existing car 1 for each of the installation periods of the existing car 1. Also, the weight storing means 9 beforehand stores the weighting factor for each of failure rates of the existing cars 1. The weighting factor is set so as to take on a larger value as the failure rate of the existing car 1 becomes higher.

In this embodiment, the weight preparing means 10 prepares the weighting factor for the use in the calculation of evaluation value of each of the existing cars 1 in the assignment determining means 7 pursuant to the flow shown in FIG. 4.

First, in Step S20, the weight preparing means 10 obtains existing car information and information concerning the production time of each of the existing cars 1 from the existing car storing means 8. Next, the process proceeds to Step S21, where the weight preparing means 10 calculates the installation period of each of the existing cars 1 from the production time of each of the existing cars 1. Successively, the weight preparing means 10 obtains the failure rate for the calculated installation period from the failure rate storing means 11.

Then, the process proceeds to Step S22, where the weight preparing means 10 prepares the weighting factor for the use in the calculation of evaluation value of each of the existing cars 1 in the assignment determining means 7 by obtaining the weighting factor for the obtained failure rate from the weight storing means 9.

Other configurations, motions, and the like are the same as those of Embodiment 1, and the detailed explanation thereof is omitted.

In the elevator group management device configured as described above, the effect that is the same as that of Embodiment 1 can be achieved, and additionally, by properly adjusting the frequency at which the existing car is assigned to a call according to the failure occurrence rate of the existing car, proper car assignment can be realized while not only suppressing the occurrence of failure but also keeping the operation efficiency high.

Embodiment 3

Figure 5:
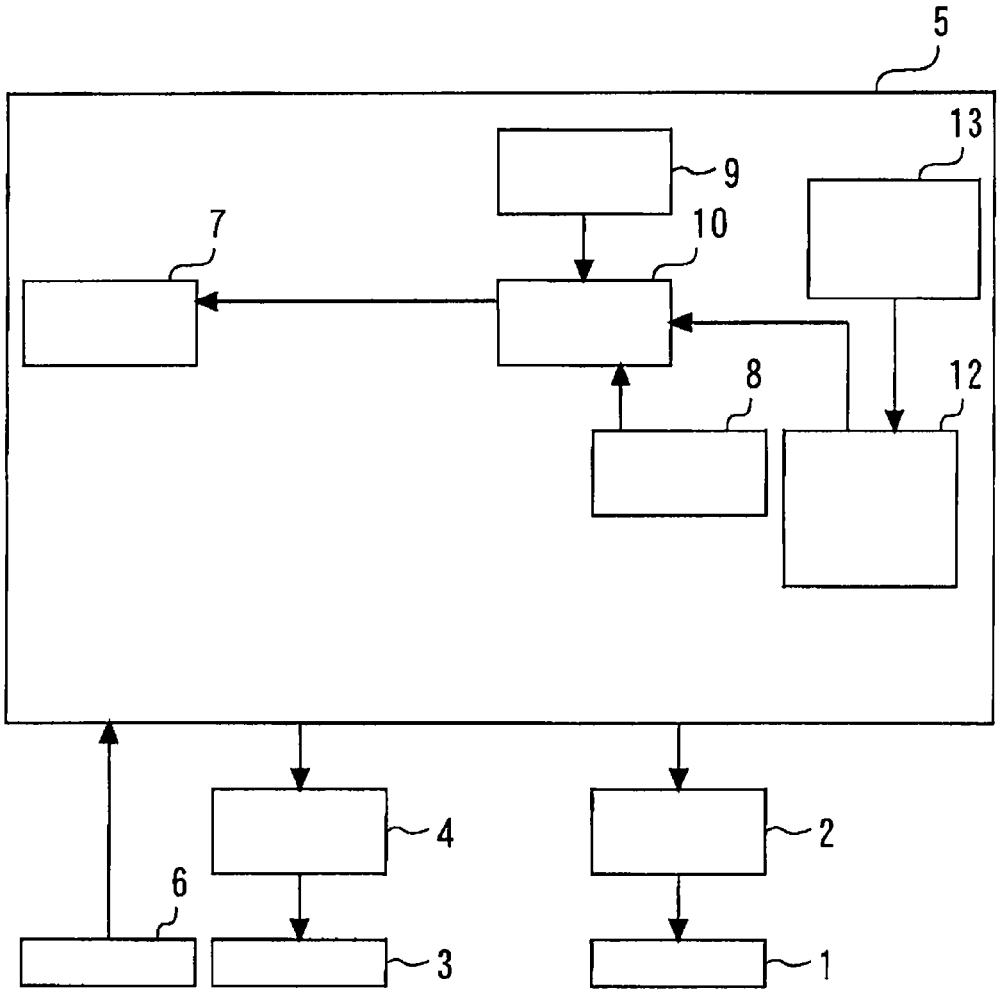
FIG. 5 is a block diagram showing the general configuration of an elevator group management device related to Embodiment 3 of the present invention.
Figure 6:
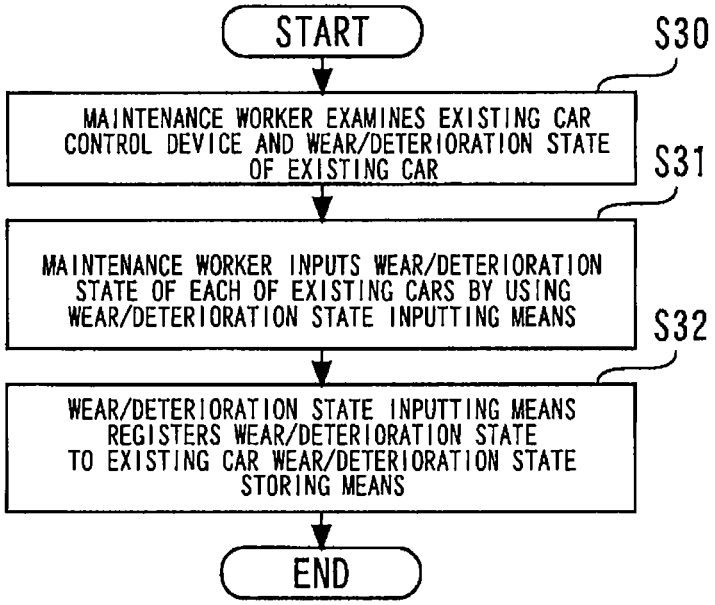
FIG. 6 is a flowchart showing wear/deterioration state registering processing in the elevator group management device related to Embodiment 3 of the present invention.
Figure 7:
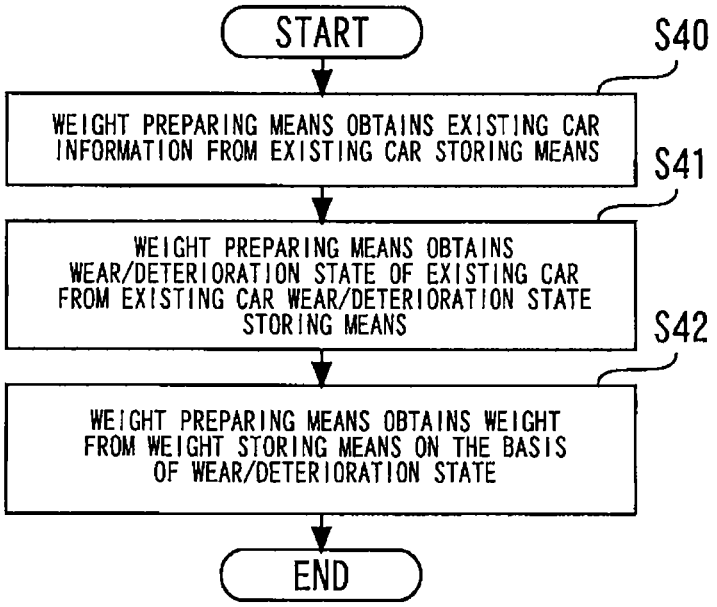
FIG. 7 is a flowchart showing weighting factor obtaining processing at the time when an evaluation value is prepared in the elevator group management device related to Embodiment 3 of the present invention.

FIGS. 5 to 7 relate to Embodiment 3 of the present invention. FIG. 5 is a block diagram showing the general configuration of an elevator group management device, FIG. 6 is a flowchart showing wear/deterioration state registering processing in the elevator group management device, and FIG. 7 is a flowchart showing weighting factor obtaining processing at the time when an evaluation value is prepared in the elevator group management device.

Embodiment 3 explained here is an embodiment in which, in the above-described configuration of Embodiment 1, the value of weighting factor used when the evaluation value of the existing car is calculated is changed according to the wear/deterioration state of the existing car.

That is to say, in FIG. 5, the group management control device 5 is provided with an existing car wear/deterioration state storing means 12 that beforehand stores the wear/deterioration state of each of the existing cars 1, and further is provided with a wear/deterioration state inputting means 13 for inputting the wear/deterioration state of each of the existing cars 1 to be stored by this existing car wear/deterioration state storing means 12.

FIG. 6 shows the flow of wear/deterioration state registering processing to the existing car wear/deterioration state storing means 12 using the wear/deterioration state inputting means 13.

First, in Step S30, for example, when periodic maintenance is accomplished, the maintenance worker examines the wear/deterioration state of the existing car 1 and the existing car control device 2. Then, the maintenance worker evaluates the wear/deterioration state of the existing car 1 and the existing car control device 2 on the basis of the examination results.

The evaluation method is established such that, for example, by completely providing a manual or the like, objectively uniformized evaluation can be carried out to prevent difference between maintenance workers. As a specific method, there is used a method in which, for example, marks are given according to the place at which wear/deterioration is recognized of the existing car 1 and the existing car control device 2 and the degree of wear/deterioration, and the wear/deterioration state is evaluated incrementally by ranking based on these marks.

The wear/deterioration state of each of the existing cars 1, which is the result of evaluation carried out as described above, is inputted to the wear/deterioration state inputting means 13 by the maintenance worker (Step S31). Then, in Step S32, the wear/deterioration state inputting means 13 registers the inputted wear/deterioration state of each of the existing cars 1 to the existing car wear/deterioration state storing means 12.

The weight storing means 9 beforehand stores the weighting factor for each of the wear/deterioration states of the existing car 1. The weighting factor is set so as to take on a larger value as the wear/deterioration state of the existing car 1 becomes worse.

In this embodiment, the weight preparing means 10 prepares the weighting factor for the use in the calculation of evaluation value of each of the existing cars 1 in the assignment determining means 7 pursuant to the flow shown in FIG. 7.

First, in Step S40, the weight preparing means 10 obtains existing car information from the existing car storing means 8. Next, the process proceeds to Step S41, where the weight preparing means 10 obtains the wear/deterioration state of each of the existing cars 1 from the existing car wear/deterioration state storing means 12 by referring to the obtained existing car information.

Then, the process proceeds to Step S42, where the weight preparing means 10 prepares the weighting factor for the use in the calculation of evaluation value of each of the existing cars 1 in the assignment determining means 7 by obtaining the weighting factor for the obtained wear/deterioration state from the weight storing means 9.

Other configurations, motions, and the like are the same as those of Embodiment 1, and the detailed explanation thereof is omitted.

In the elevator group management device configured as described above, the effect that is the same as that of Embodiment 1 can be achieved, and additionally, by properly adjusting the frequency at which the existing car is assigned to a call according to the wear/deterioration state of the existing car, proper car assignment can be realized while not only suppressing the occurrence of failure but also keeping the operation efficiency high.

Embodiment 4

Figure 8:
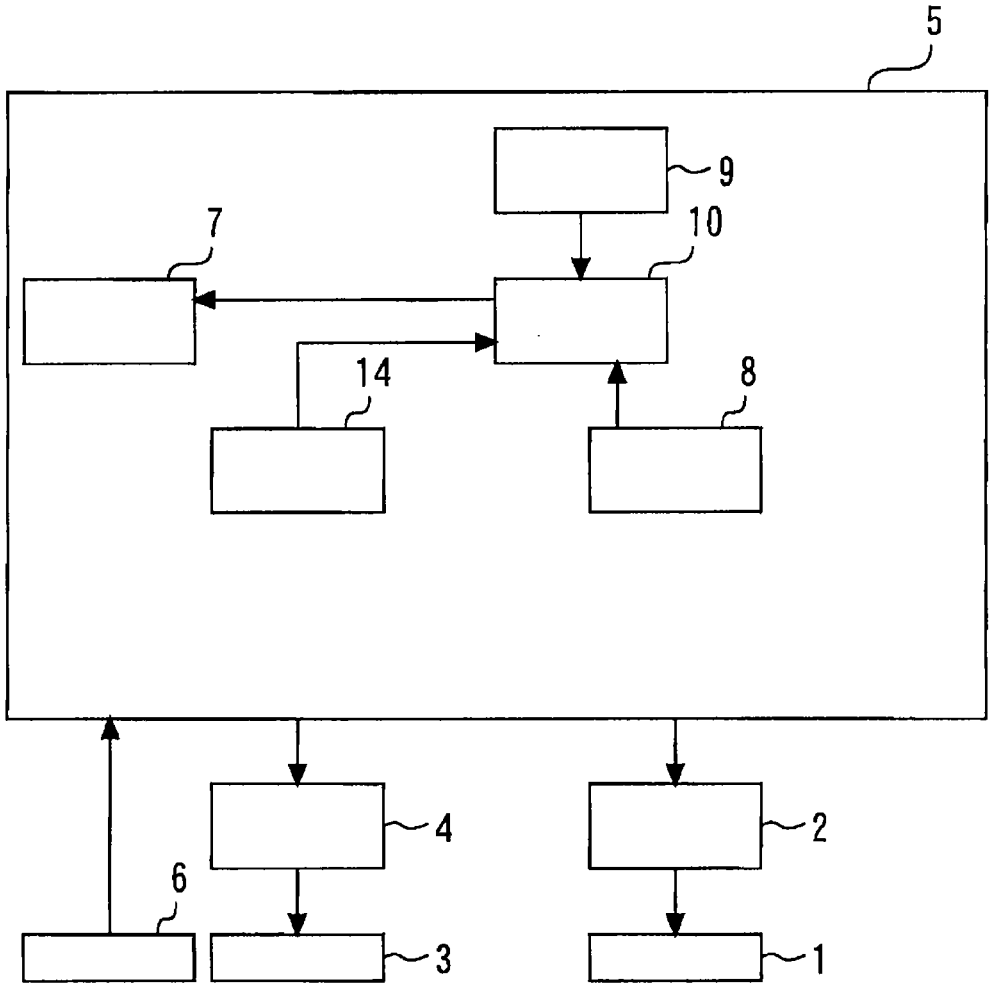
FIG. 8 is a block diagram showing the general configuration of an elevator group management device related to Embodiment 4 of the present invention.
Figure 9:
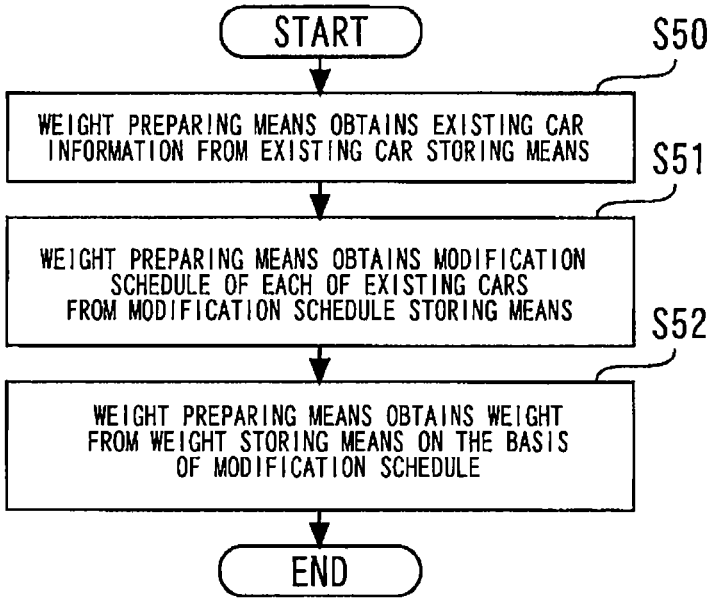
FIG. 9 is a flowchart showing weight factor obtainment processing at the time when an evaluation value is prepared in the elevator group management device related to Embodiment 4 of the present invention.

FIGS. 8 and 9 relate to Embodiment 4 of the present invention. FIG. 8 is a block diagram showing the general configuration of an elevator group management device, and FIG. 9 is a flowchart showing weight factor obtainment processing at the time when an evaluation value is prepared in the elevator group management device.

Embodiment 4 explained here is an embodiment in which, in the above-described configuration of Embodiment 1, the value of weighting factor used when the evaluation value of the existing car is calculated is changed according to the time period until scheduled modification of the existing car.

That is to say, in FIG. 8, the group management control device 5 is provided with a modification schedule storing means 14 that beforehand stores the modification schedule planned for each of the existing cars 1. The weight storing means 9 beforehand stores the weighting factor for each of time periods until modifications of the existing cars 1. The weighting factor is set so as to take on a larger value as the time period until modification of the existing car 1 becomes longer.

In this embodiment, the weight preparing means 10 prepares the weighting factor for the use in the calculation of evaluation value of each of the existing cars 1 in the assignment determining means 7 pursuant to the flow shown in FIG. 9.

First, in Step S50, the weight preparing means 10 obtains existing car information from the existing car storing means 8. Next, the process proceeds to Step S51, where the weight preparing means 10 obtains the modification schedule planned for each of the existing cars 1 from the modification schedule storing means 14 by referring to the obtained existing car information.

Then, the process proceeds to Step S52, where the weight preparing means 10 calculates the time period until modification of each of the existing cars 1 from the obtained modification schedule. Successively, the weight preparing means 10 prepares the weighting factor for the use in the calculation of evaluation value of each of the existing cars 1 in the assignment determining means 7 by obtaining the weighting factor for the weight factor for the calculated time period until modification from the weight storing means 9.

Other configurations, motions, and the like are the same as those of Embodiment 1, and the detailed explanation thereof is omitted.

In the elevator group management device configured as described above, the effect that is the same as that of Embodiment 1 can be achieved, and additionally, by properly adjusting the frequency at which the existing car is assigned to a call according to the time period until modification of the existing car, proper car assignment can be realized while not only suppressing the occurrence of failure but also keeping the operation efficiency high.

Embodiment 5

Figure 11:
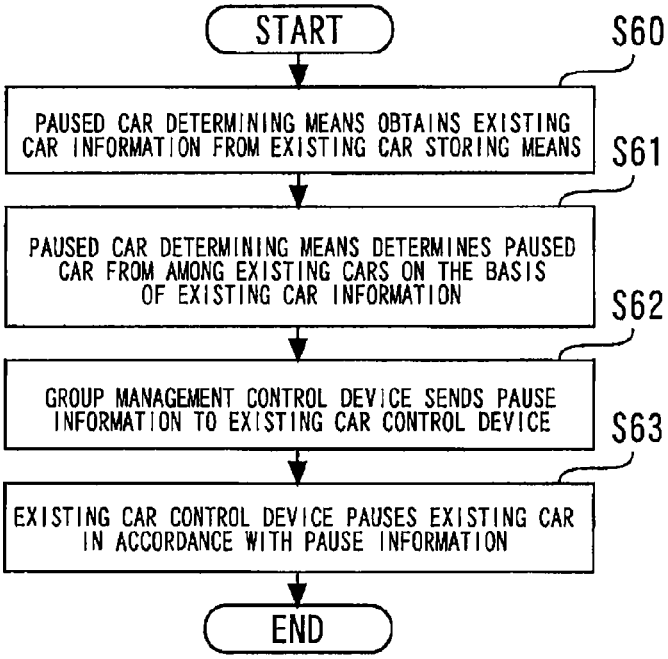
FIG. 11 is a flowchart showing car pause motion in the elevator group management device related to Embodiment 5 of the present invention.
Figure 12:
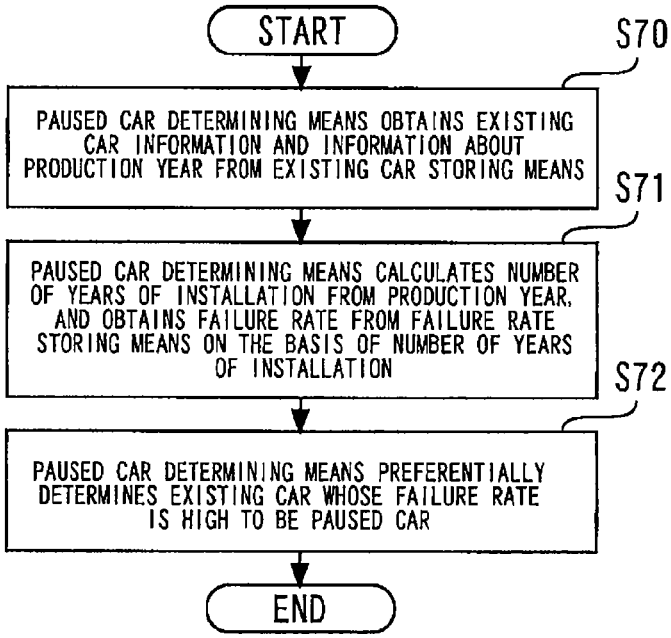
FIG. 12 is a flowchart showing first paused car determining processing in the elevator group management device related to Embodiment 5 of the present invention.
Figure 13:
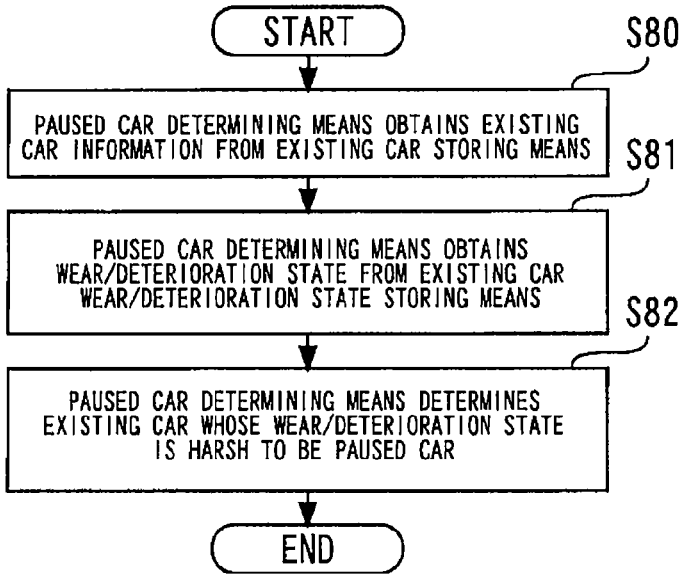
FIG. 13 is a flowchart showing second paused car determining processing in the elevator group management device related to Embodiment 5 of the present invention.
Figure 14:
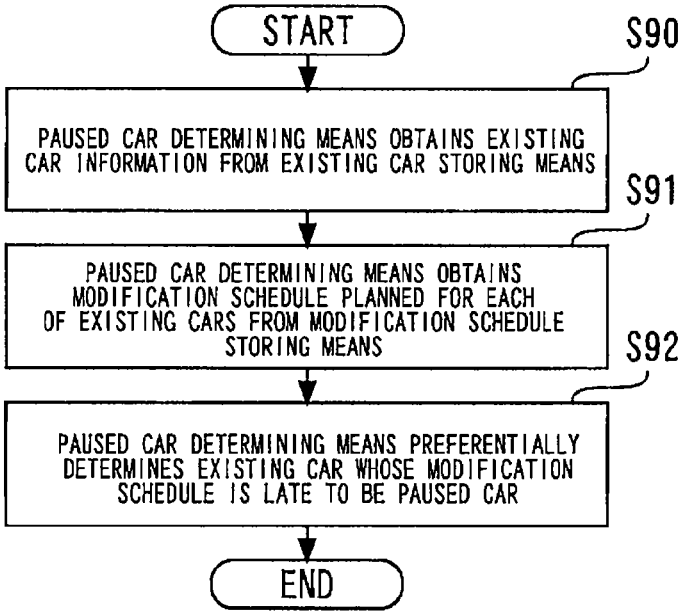
FIG. 14 is a flowchart showing third paused car determining processing in the elevator group management device related to Embodiment 5 of the present invention.

FIGS. 10 to 14 relate to Embodiment 5 of the present invention. FIG. 10 is a block diagram showing the general configuration of an elevator group management device, FIG. 11 is a flowchart showing car pause motion in the elevator group management device, FIG. 12 is a flowchart showing first paused car determining processing in the elevator group management device, FIG. 13 is a flowchart showing second paused car determining processing in the elevator group management device, and FIG. 14 is a flowchart showing third paused car determining processing in the elevator group management device.

Embodiment 5 explained here is an embodiment in which, in the above-described configurations of Embodiments 1 to 4, when the elevator operation state becomes slack, and the operation of any of the plurality of cars is paused from the viewpoint of electric power saving or the like, the existing car is preferentially determined to be a paused car.

That is to say, in FIG. 10, the group management control device 5 is provided with a paused car determining means 15 that determines a paused car whose operation is paused from among the plurality of cars including the existing car 1 and newly-installed car 3 when the elevator operation state becomes slack.

This paused car determining means 15 preferentially determines the existing car 1 to be a paused car from among the plurality of cars on the basis of the existing car information stored by the existing car storing means 8. Also, at this time, if the group management control device 5 is provided with any of the failure rate storing means 11, the existing car wear/deterioration state storing means 12, and the modification schedule storing means 14, the paused car is determined by using the information stored by these storing means as well.

The flowchart of FIG. 11 shows the car pause motion in the elevator group management device.

First, when the group management control device 5 judges, from the call register state, the operation state of each car, and the like, that the elevator is deserted, the group management control device 5 makes a judgment to pause some cars among the plurality of cars being subjected to group management. If it is judged that some cars are paused, in Step S60, the paused car determining means 15 obtains existing car information from the existing car storing means 8.

In the successive Step S61, the paused car determining means 15 determines a paused car from among the existing cars 1 on the basis of the obtained existing car information. Then, the process proceeds to Step S62, where the group management control device 5 sends pause information to the existing car control device 2 that controls the existing car 1 determined to be the paused car. In Step S63, on receipt of this pause information, the existing car control device 2 pauses the existing car 1 in accordance with the received pause information.

FIG. 12 is a flowchart showing the case where, when the existing car storing means 8 stores information concerning the production time of each of the existing cars 1, and the group management control device 5 is provided with the failure rate storing means 11, the paused car determining means 15 determines a paused car by using the storage contents of these storing means.

First, in Step S70, the paused car determining means 15 obtains existing car information and information concerning the production time of each of the existing cars 1 from the existing car storing means 8. Next, the process proceeds to Step S31, where the paused car determining means 15 calculates the installation period of each of the existing cars 1 from the production time of each of the existing cars 1. Successively, the paused car determining means 15 obtains the failure rate for the calculated installation period from the failure rate storing means 11. Then, the process proceeds to Step S32, where the paused car determining means 15 compares the obtained failure rates of the existing cars 1, and preferentially determines the existing car 1 whose failure rate is relatively high to be a paused car.

FIG. 13 is a flowchart showing the case where, when the group management control device 5 is provided with the existing car wear/deterioration state storing means 12, the paused car determining means 15 determines a paused car by using the wear/deterioration state of the existing car 1 stored by the existing car wear/deterioration state storing means 12.

First, in Step S80, the paused car determining means 15 obtains existing car information from the existing car storing means 8. Next, the process proceeds to Step S81, where the paused car determining means 15 obtains the wear/deterioration state of each of the existing cars 1 from the existing car wear/deterioration state storing means 12 by referring to the obtained existing car information. Then, the process proceeds to Step S82, where the paused car determining means 15 compares the obtained wear/deterioration states of the existing cars 1, and preferentially determines the existing car 1 whose wear/deterioration state is relatively harsh to be a paused car.

FIG. 14 is a flowchart showing the case where, when the group management control device 5 is provided with the modification schedule storing means 14, the paused car determining means 15 determines a paused car by using the modification schedule of the existing car 1 stored by the modification schedule storing means 14.

First, in Step S90, the paused car determining means 15 obtains existing car information from the existing car storing means 8. Next, the process proceeds to Step S91, where the paused car determining means 15 obtains the modification schedule planned for each of the existing cars 1 from the modification schedule storing means 14 by referring to the obtained existing car information. Then, the process proceeds to Step S92, where the paused car determining means 15 calculates the time period until modification of each of the existing cars 1 from the obtained modification schedule. Successively, the paused car determining means 15 compares the calculated time periods until modification of the existing cars 1, and preferentially determines the existing car 1 whose time period until modification is relatively long to be a paused car.

Other configurations, motions, and the like are the same as those of Embodiments 1 to 4, and the detailed explanation thereof is omitted.

The above is an explanation of the case where the failure rates obtained from the failure rate storing means 11, the wear/deterioration states obtained from the existing car wear/deterioration state storing means 12, and time periods until modification determined from the modification schedule obtained from the modification schedule storing means 14 are directly compared in the paused car determining means 15. However, in this respect, the configuration may be made such that after the weight storing means 9 has obtained weighting factors for failure rate, wear/deterioration state, and time period until modification, the existing car 1 in which the obtained weighting factor is the highest is determined to be a paused car.

In the elevator group management device configured as described above, the effects that are the same as those of Embodiments 1 to 4 can be achieved, and additionally, by preferentially pausing the existing car and by decreasing the usage frequency of the existing car, the occurrence of failure in the existing car can be suppressed.

INDUSTRIAL APPLICABILITY

The present invention can be used for an elevator group management device that manages and controls a plurality of cars including an existing car and a newly-installed car as one group.

DESCRIPTION OF SYMBOLS

1 existing car
2 existing car control device
3 newly-installed car
4 newly-installed car control device
5 group management control device
6 hall button
7 assignment determining means
8 existing car storing means
9 weight storing means
10 weight preparing means
11 failure rate storing means
12 existing car wear/deterioration state storing means
13 wear/deterioration state inputting means
14 modification schedule storing means
15 paused car determining means

The invention claimed is:

1. An elevator group management device which manages and controls a plurality of cars including an existing car and a newly-installed car as one group, comprising:

an existing car control device which controls the existing car;

a newly-installed car control device which controls the newly-installed car;

evaluation value preparing means which prepares evaluation values for the existing car and the newly-installed car;

assignment determining means which determines a car assigned to a call from among the plurality of cars on a basis of the evaluation values prepared by the evaluation value preparing means;

existing car storing means which beforehand stores information concerning which of the plurality of cars is the existing car;

weight storing means which beforehand stores a weighting factor for the existing car in the evaluation value; and failure rate storing means which beforehand stores the failure rate of the existing car for the installation period of the existing car, wherein the existing car storing means beforehand stores information concerning the production time of each of the existing cars, the weight storing means beforehand stores the weighting factor for the failure rate, and the evaluation value preparing means determines the installation period of the existing car from the information concerning the production time of existing car stored by the existing car storing means, obtains the failure rate for the determined installation period of the existing car from the failure rate storing means, obtains the weighting factor for the obtained failure rate from the weight storing means, and prepares the evaluation value for the existing car.

2. The elevator group management device according to claim 1, wherein the evaluation value is arrival prediction time to the floor at which a call for each car has been registered, the assignment determining means determines the car whose arrival prediction time is the shortest to be an assigned car, the evaluation value preparing means prepares the evaluation value for the existing car by multiplying the arrival prediction time by the weighting factor obtained from the weight storing means, and the weighting factor for the existing car stored by the weight storing means is set to a value of 1 or larger.

3. The elevator group management device according to claim 1, further comprising:

wear/deterioration state storing means which beforehand stores the wear/deterioration state of each of the existing cars, wherein the weight storing means beforehand stores the weighting factor for the wear/deterioration state, and the evaluation value preparing means obtains the wear/deterioration state of the existing car from the wear/deterioration state storing means, obtains the weight factor for the obtained wear/deterioration state from the weight storing means, and prepares the evaluation value for the existing car.

4. The elevator group management device according to claim 2, further comprising:

wear/deterioration state storing means which beforehand stores the wear/deterioration state of each of the existing cars, wherein the weight storing means beforehand stores the weighting factor for the wear/deterioration state, and the evaluation value preparing means obtains the wear/deterioration state of the existing car from the wear/deterioration state storing means, obtains the weight factor for the obtained wear/deterioration state from the weight storing means, and prepares the evaluation value for the existing car.

5. The elevator group management device according to claim 3, further comprising:

wear/deterioration state inputting means configured for inputting the wear/deterioration state of each of the existing cars to be stored by the wear/deterioration state storing means.

6. The elevator group management device according to claim 4, further comprising:

wear/deterioration state inputting means configured for inputting the wear/deterioration state of each of the existing cars to be stored by the wear/deterioration state storing means.

7. The elevator group management device according to claim 1, further comprising:

modification schedule storing means which beforehand stores the modification schedule of each of the existing cars, wherein the weight storing means beforehand stores the weighting factor for time period until modification, and the evaluation value preparing means determines the time period until modification of the existing car from the modification schedule of the existing car stored by the modification schedule storing means, obtains the weighting factor for the determined time period until modification of the existing car from the weight storing means, and prepares the evaluation value for the existing car.

8. The elevator group management device according to claim 2, further comprising:

modification schedule storing means which beforehand stores the modification schedule of each of the existing cars, wherein the weight storing means beforehand stores the weighting factor for time period until modification, and the evaluation value preparing means determines the time period until modification of the existing car from the modification schedule of the existing car stored by the modification schedule storing means, obtains the weighting factor for the determined time period until modification of the existing car from the weight storing means, and prepares the evaluation value for the existing car.

9. The elevator group management device according to claim 1, further comprising:

paused car determining means which preferentially determines the existing car to be a paused car on a basis of the storage contents of the existing car storing means.

10. The elevator group management device according to claim 2, further comprising:

paused car determining means which preferentially determines the existing car to be a paused car on a basis of the storage contents of the existing car storing means.

11. The elevator group management device according to claim 1, further comprising:

paused car determining means which determines the installation period of the existing car from the information concerning the production time of existing car stored by the existing car storing means, obtains the failure rate for the determined installation period of the existing car from the failure rate storing means, and preferentially determines the existing car whose failure rate obtained is relatively high to be a paused car.

12. The elevator group management device according to claim 3, further comprising:

paused car determining means which obtains the wear/deterioration state of the existing car from the wear/deterioration state storing means, and preferentially determines the existing car whose wear/deterioration state obtained is relatively harsh to be a paused car.

13. The elevator group management device according to claim 4, further comprising:

paused car determining means which obtains the wear/deterioration state of the existing car from the wear/deterioration state storing means, and preferentially determines the existing car whose wear/deterioration state obtained is relatively harsh to be a paused car.

14. The elevator group management device according to claim 7, further comprising:

paused car determining means which determines the time period until modification of the existing car from the modification schedule of the existing car stored by the modification schedule storing means, and preferentially determines the existing car whose time period until modification determined is relatively long to be a paused car.

15. The elevator group management device according to claim 8, further comprising:

paused car determining means which determines the time period until modification of the existing car from the modification schedule of the existing car stored by the modification schedule storing means, and preferentially determines the existing car whose time period until modification determined is relatively long to be a paused car.

* * * * *